US007367561B2

(12) United States Patent
Blaha et al.

(10) Patent No.: US 7,367,561 B2
(45) Date of Patent: May 6, 2008

(54) CARD SHUFFLER

(75) Inventors: Ernst Blaha, Tullnerbach (AT); Peter Krenn, Neufeld (AT)

(73) Assignee: Shuffle Master, Inc., Las Vegas, NV (US)

( * ) Notice: Subject to any disclaimer, the term of this patent is extended or adjusted under 35 U.S.C. 154(b) by 415 days.

(21) Appl. No.: 10/256,639

(22) Filed: Sep. 27, 2002

(65) Prior Publication Data

US 2003/0071413 A1 Apr. 17, 2003

(30) Foreign Application Priority Data

Oct. 11, 2001 (AT) ..... GM782/2001 U

(51) Int. Cl.
*A63F 1/12* (2006.01)

(52) U.S. Cl. ..... 273/149 R; 209/547

(58) Field of Classification Search ..... 273/149 R, 273/149 P; 209/547
See application file for complete search history.

(56) References Cited

U.S. PATENT DOCUMENTS

| | | | | |
|---|---|---|---|---|
| 4,497,488 | A | 2/1985 | Plevyak et al. | 273/149 R |
| 4,512,580 | A | 4/1985 | Matviak | |
| 4,586,712 | A | 5/1986 | Lorber et al. | 273/149 R |
| 4,659,082 | A | 4/1987 | Greenberg | 273/149 R |
| 4,667,959 | A | 5/1987 | Pfeiffer et al. | 273/149 R |
| 4,832,342 | A | 5/1989 | Plevyak et al. | 273/149 R |
| 5,240,140 | A | 8/1993 | Huen | 221/13 |
| 5,683,085 | A | 11/1997 | Johnson et al. | 273/149 R |
| 5,695,189 | A | 12/1997 | Breeding et al. | 273/149 R |
| 5,944,310 | A | 8/1999 | Johnson et al. | 273/149 R |
| 5,989,122 | A | 11/1999 | Roblejo | |
| 6,019,368 | A | 2/2000 | Sines et al. | |
| 6,068,258 | A | 5/2000 | Breeding et al. | 273/149 R |
| 6,139,014 | A | 10/2000 | Breeding et al. | 273/149 R |
| 6,149,154 | A | 11/2000 | Grauzer et al. | 273/149 R |
| 6,254,096 | B1 | 7/2001 | Grauzer et al. | 273/149 R |
| 6,267,248 | B1 | 7/2001 | Johnson et al. | 209/547 |
| 6,325,373 | B1 | 12/2001 | Breeding et al. | 273/149 R |
| 6,655,684 | B2 * | 12/2003 | Grauzer et al. | 273/149 R |
| 6,659,460 | B2 * | 12/2003 | Blaha et al. | 273/149 R |
| 6,676,127 | B2 * | 1/2004 | Johnson et al. | 273/149 R |
| 6,889,979 | B2 * | 5/2005 | Blaha et al. | 273/149 R |
| 2005/0040594 | A1 * | 2/2005 | Krenn et al. | 273/149 R |

FOREIGN PATENT DOCUMENTS

| | | |
|---|---|---|
| EP | 0 777 514 | 2/2000 |
| WO | WO 99/52611 | 10/1999 |

* cited by examiner

*Primary Examiner*—Robert E. Pezzuto
*Assistant Examiner*—Alex F. R. P. Rada, II
(74) *Attorney, Agent, or Firm*—Mark A. Litman & Associates, PA

(57) ABSTRACT

A card shuffler has a drivable shuffling storage means (2') which is provided with compartments (69) for receiving cards (13). The storage means is associated with an input apparatus for the insertion of cards one by one into the compartments (69) and an output apparatus spaced from the same for the shuffled cards, with the drive of the shuffling storage means (2'), the input apparatus and the output apparatus being controlled by a microprocessor. The number of shuffled cards supplied to the output apparatus at a time is adjusted to be the number of cards necessary per player for the respective card game. In order to improve the shuffling result in such a shuffler it is provided that the cards supplied to the output apparatus are taken from at least two compartments (69) of the shuffling storage means (2').

1 Claim, 5 Drawing Sheets

CARD SHUFFLER

The invention relates to a card shuffler.

Card shuffling devices have been known for a long time. An example of a shuffling device is described in U.S. Pat. No. 4,659,082. In this known shuffler the shuffling vessel is formed by a horizontally arranged drivable drum which is provided with radially extending shafts for receiving a card each. An input station for receiving a stack of discarded playing cards is provided through which the individual shafts of the drum are supplied. The storage container for the shuffled cards is supplied by the drum. Following the activation of a card ejector, the individual cards are pushed into the storage container at random.

A similar card shuffler has become known from U.S. Pat. No. 4,586,712 in which the drum is vertical.

A very high degree of shuffling is achieved with such card shufflers. The foreseeability of the card sequence in the shuffled card stack is virtually impossible for a third party even in the case of using electronic aids.

Said known solutions allow retrieving the shuffled cards individually from the respective output apparatus. This leads to the disadvantage, however, that such card shufflers can only be used for certain games, but not for such games where a removal in stacks of the shuffled cards is provided.

A card shuffler is known from U.S. Pat. No. 6,149,154 which allows preparing the cards in a stack-wise fashion. The card shuffler as disclosed therein is provided with a shuffling vessel for receiving several cards per compartment, with the number of shuffled cards per compartment always corresponding to the number of cards per player required for the respective game. This number of required cards per player is known as a "hand" in the field. A hand corresponds to five cards in the game of poker. This means that as many cards are mixed in a compartment as are dealt to a player in a game round. In a card shuffler according to U.S. Pat. No. 6,149,154, a shuffling process takes place during the random filling of the cards into the individual compartments of the shuffling container. The cards are always dealt in the composition with which the cards were shuffled per compartment. This leads to the disadvantage that the degree of shuffling of the cards is often very low in such card games where an entire hand of cards is to be dealt. A further disadvantage is that always the preset required number of cards per player needs to be shuffled in each of the compartments.

It is the object of the present invention to avoid this disadvantage and to propose a card shuffler of the kind mentioned above which is capable of cutting a hand of playing cards, with the degree of shuffling being very high and the shuffling process still being capable of being kept very short.

This is achieved in accordance with the invention in a card shuffler of the kind mentioned above by the characterizing features of claim 1.

As a result, a further shuffling is performed in addition to a first shuffling which occurs by the introduction of the cards into the shuffler storage means, namely during the composition of a hand of playing cards from several compartments of the shuffling storage means and the delivery of said cards in stacks to the output apparatus.

The invention is now explained in closer detail, wherein:

FIG. 1 schematically shows a card shuffler in accordance with the invention in which a cover has been removed;

Figure 1:
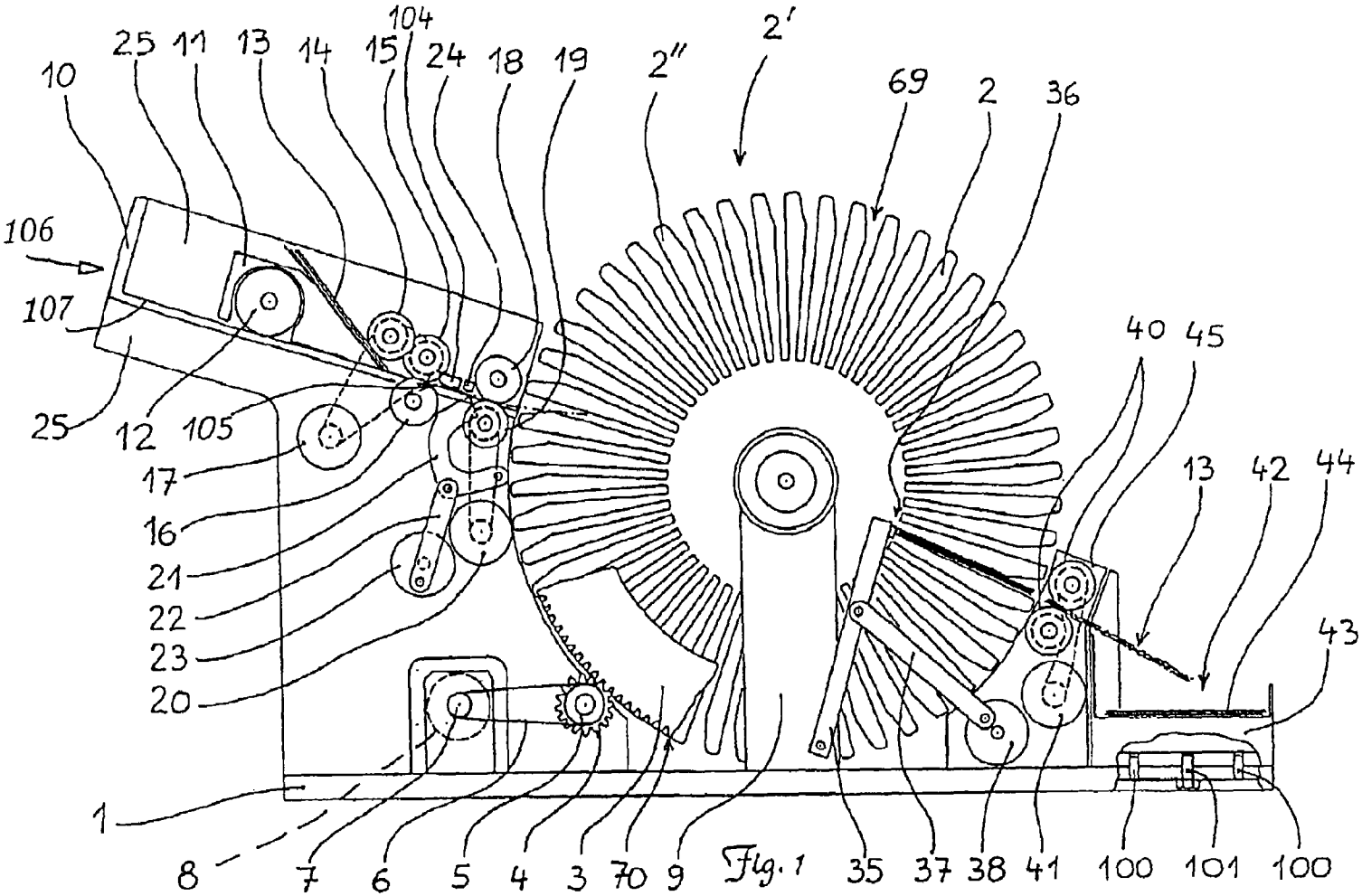

A shuffling storage means 2' is situated on a bracket consisting of two legs 9 situated on a base plate 1, which shuffling storage means is formed by a rotatably held drum 2. Said drum 2 is connected via spacers 62 (FIG. 5) with two disks 3. The flanges 2" of the cylinder 2 are provided with compartment-like slots 69 which are provided for receiving cards.

Said disks 3 are each provided with a circular toothing 70. The shuffling storage means 2' can be driven via a pinion 4 and a toothed pulley 5 which is rigidly connected with the same, with both being jointly held rotatably in plate bars 25, and a toothed belt 6 via a second toothed pulley 7 and a motor 8. Said motor 8 is driven via a random-check generator and optionally moves the shuffling storage means 2' in mutually opposite directions, so that an oscillating movement of the shuffling storage means 2' can occur.

Figure 2:
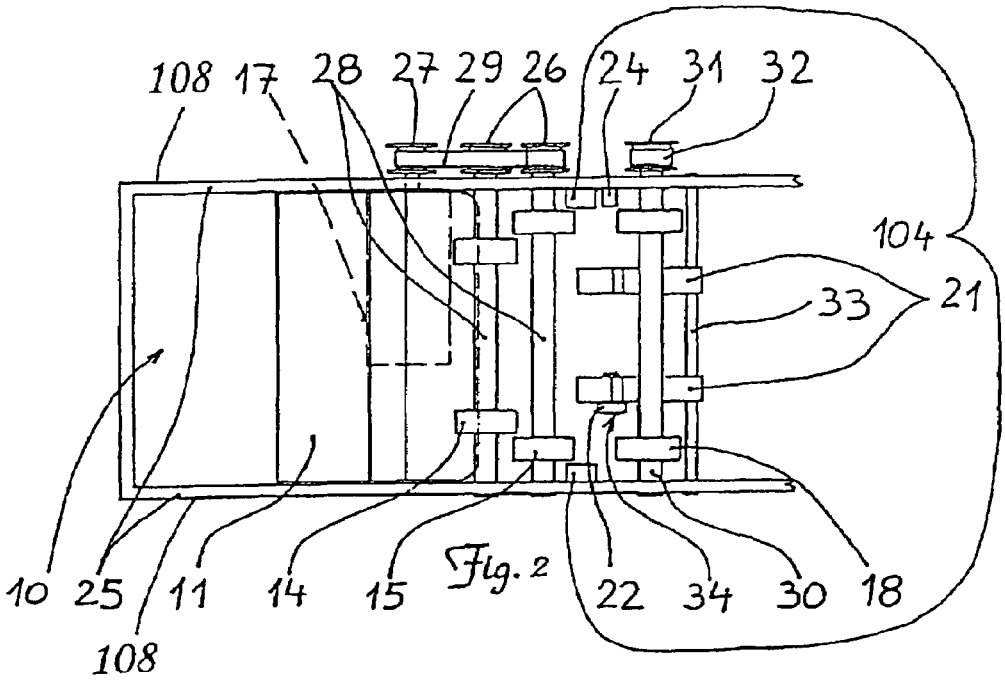
FIG. 2 shows a top view of the input apparatus.

A storage container 10 for the played cards 13 is provided which is part of an input apparatus. It comprises a wedge 11 which rolls off by way of a roller 12 which is arranged rotatably in the same on an inclined floor of the storage container 10 against two elastic rollers 14 (FIG. 2). The two rollers 14 are held rotatably on a common shaft 28 in the two plate bars 25 and can be driven jointly with the rollers 15 via two pulleys 26, a toothed belt 29 as well as a pulley 27 via a motor 17. Two rollers 16 touch the two rollers 15 at the circumference, so that they are co-rotated by the surface friction.

The pair of rollers 19 and the pair of rollers 18 which touches the same at the circumference, which each sit on a shaft 30, are drivable in the manner as described above by the motor 23.

The two levers 21 are used for completely pushing in the respectively moved card into a compartment 69 of the shuffling storage means 2' and are oscillatingly drivable by way of a rod 22 which is swivelably connected with one of the levers 21 via a shaft 34 by means of an eccentric plate 23 seated on a motor.

Figure 3:
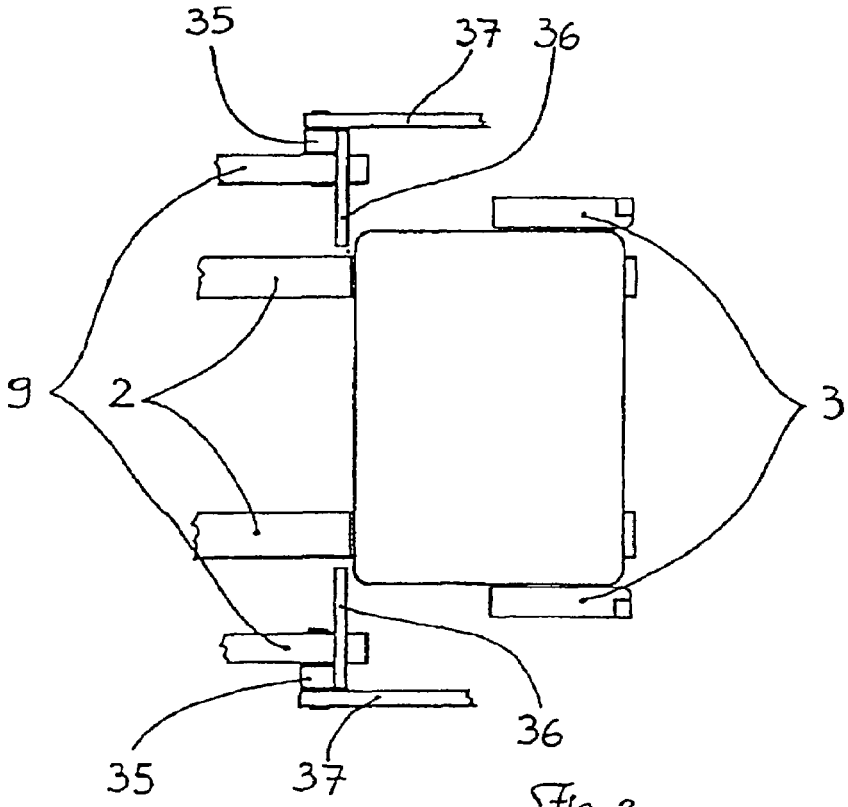
FIG. 3 shows detail of the output apparatus.

The output of cards 13 from the compartments 69 in the card storage means 42 is carried out by means of two swivel arms 35 which are swivelably held in the two legs 9 and are oscillatingly drivable by means of levers 37 and by means of an eccentric plate 38 seated on a motor. These two swivel arms 35 each carry at their upper end an inwardly projecting rail 36 (FIG. 3) which grasps the cards situated in a compartment 69 and conveys the same to a nip line of two clamping rollers 40. Said clamping rollers 40 are held in the plate bars 45 and are simultaneously drivable by a motor 41.

The clamping rollers 40 convey the respectively moved cards 13 to the card storage means 42 as shown in FIG. 1 for the shuffled cards for the purpose of a stack-wise removal of the cards 13.

A card storage means 42 is formed substantially by a U-shaped table 43 in which the cards 13 are deposited on a stack 44. The cards can be upwardly removed from said table 43 by the croupier in an optionally stack-wise manner.

Figure 4:
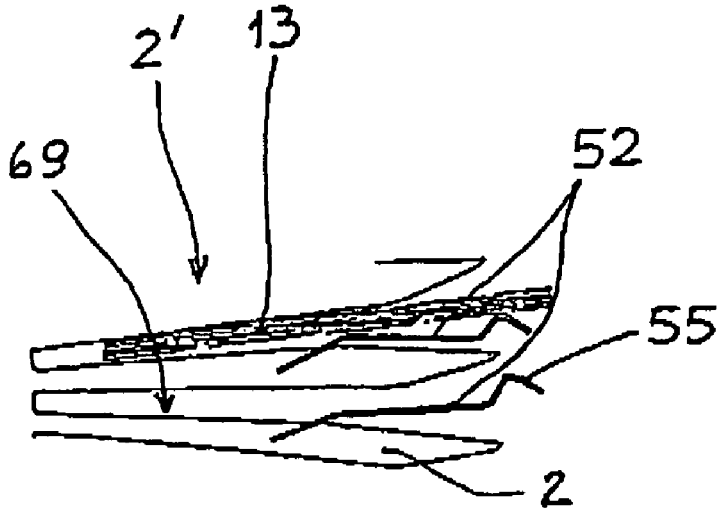
FIGS. 4 and 4A show details of variants of the arrangement of the compartments of the shuffler storage means.
Figure 4A:
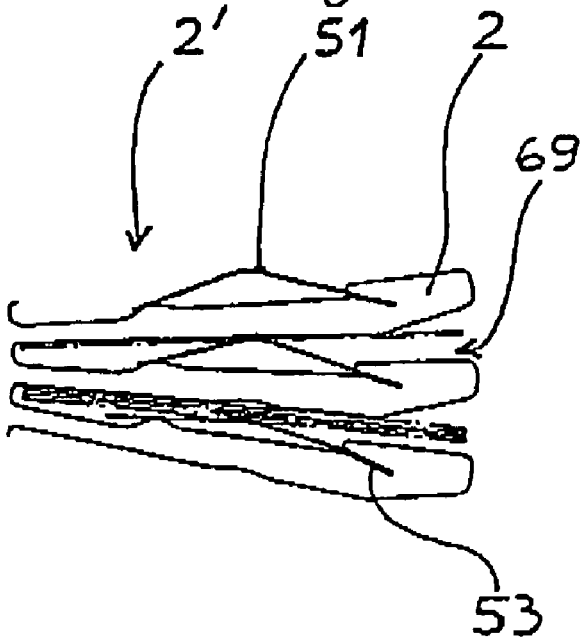

As is shown in FIGS. 4 and 4A, springs 51, 52 are provided in the compartments 69 of the shuffling storage means 2', which springs produce a clamping of the card(s) 13 pushed into the respective compartment 69.

A spring 52 is provided with a bend-off 55 which covers the radially outer openings of the compartments 69 and securely prevents the cards being ejected outwardly by centrifugal force during the rotation of the shuffling storage means 2'.

The springs 51 according to FIG. 4A are arranged as bent or offset leaf springs and are inserted into a slot 53 of the one wall of the compartment 69 and press against the respective opposite wall of the compartment 69. The card pushed into the respective compartment 69 is therefore clamped between said spring 51 and the opposite wall of the compartment 69 and is held in this way in the respective compartment 69.

The output of the cards of a compartment 69 is performed in such a way that the card 13 or a stack of up to nine cards for example is ejected with force. This occurs by means of the swiveling arms 35 and the rails 36, as has already been explained above. The springs 51, 52 are deformed during the ejection of the card(s) 13.

Figure 5:
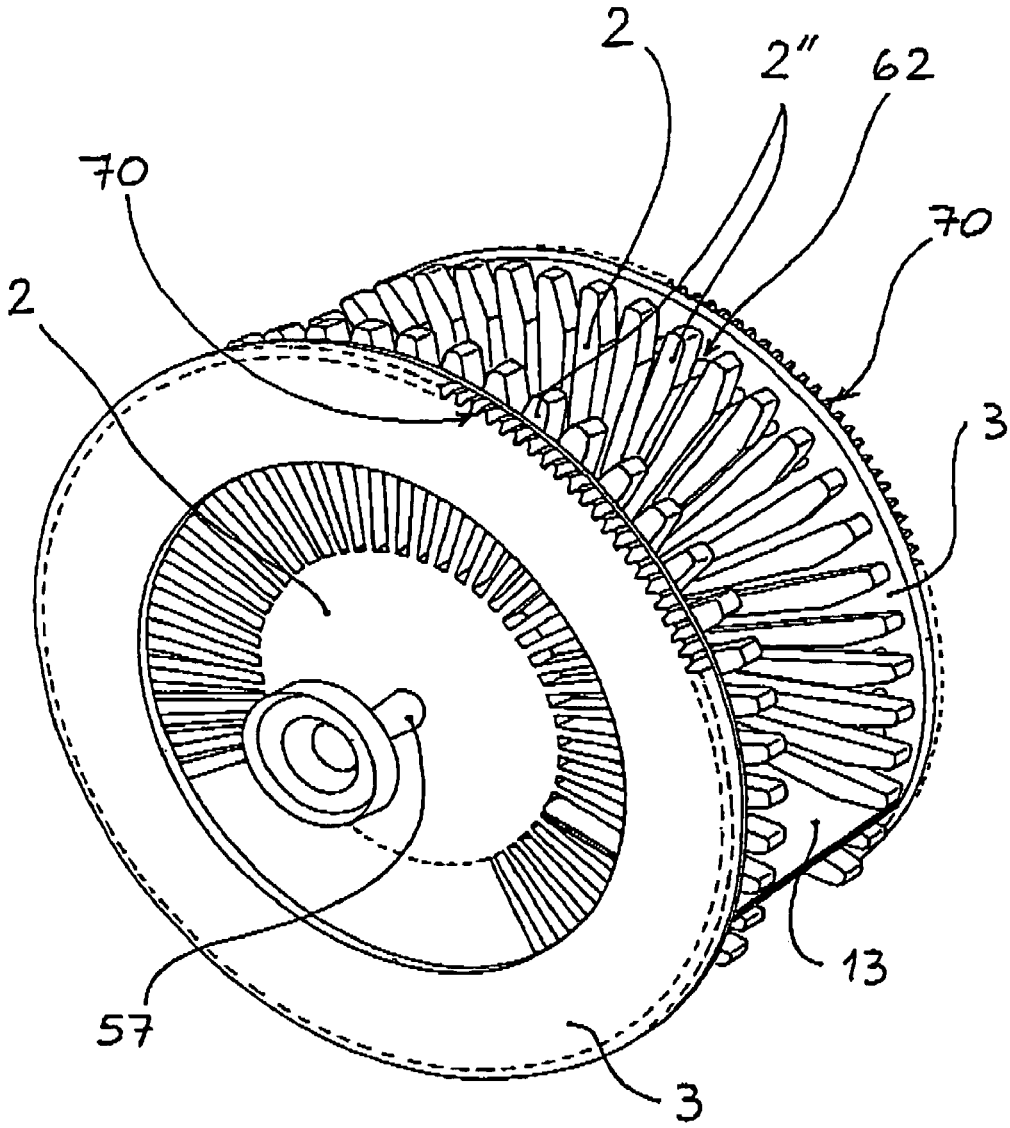
FIG. 5 shows an axonometric representation of the shuffler storage means.
Figure 6:
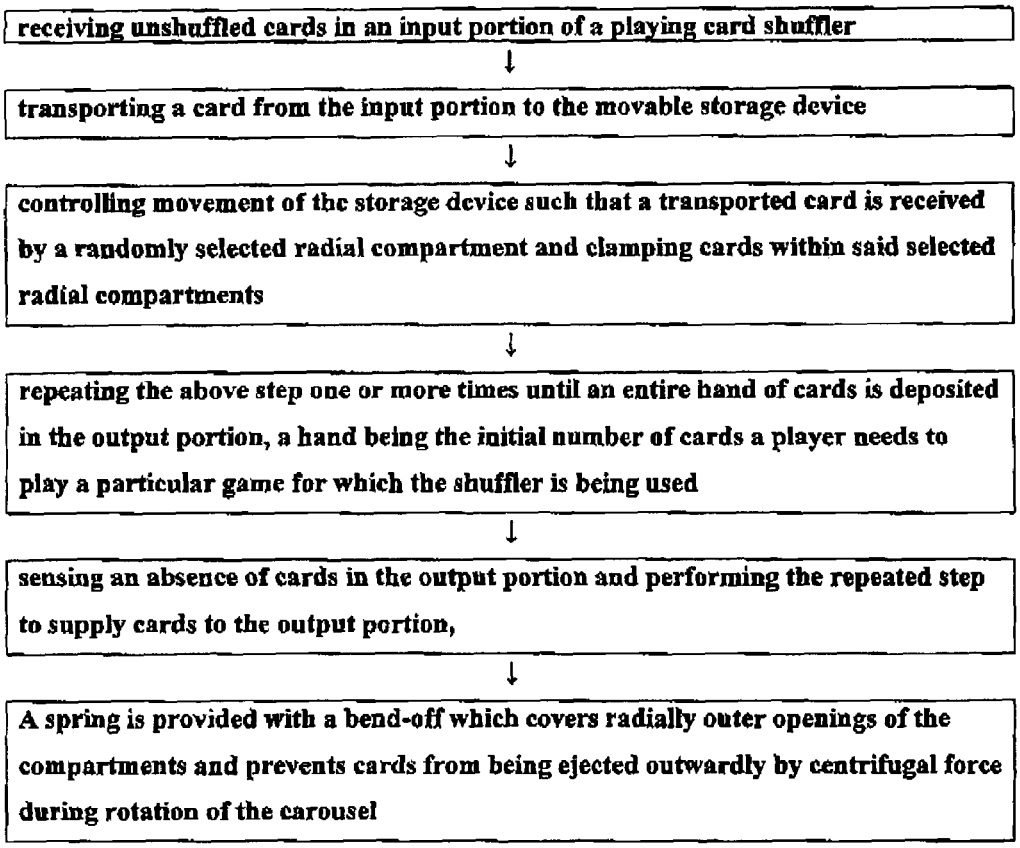
FIG. 6 shows a flow diagram of one non-exclusive embodiment of a process according to the present invention.

As is shown in FIGS. 1 and 5, the drum 2 rests with the axle journals 57 in receiving means of the legs 9 and can be removed or lifted off from the same with ease. Since the compartments 69 are provided with springs 51, 52, the cards 13 can remain in their compartments when the drum 2 is removed.

Below there is a detailed description of how the card shuffler in accordance with the invention works.

Before the card shuffler is put into operation the game leader enters the type of card game via an input device (not shown) or the number of cards per player which is provided for this type of card game. Unshuffled cards, i.e. such that have already been used in the game, are then placed in the storage container 10, with the wedge 11 first being pulled away in the direction away from the shuffling storage means 2' in order to enable the insertion of the card stack. Once the stack has been entered, the wedge 11 is released again and presses the cards 13 against the two rollers 15. Lever 21 is used to push the individual cards 13 into different compartments 69 of the shuffling storage means 2'. The latter is rotated in a random fashion via motor 8, toothed pulleys 5, 7, and pinions 4, so that the cards are distributed in a random way among the individual compartments 69 of the shuffling storage means 2'.

The removal of the cards 13 from the compartments 69 occurs by the swiveling arms 35 and the respective rails 36, with the same always emptying an entire compartment in the present embodiment. It is also possible, however, to remove one card 13 each from the compartment 69 of the shuffling storage means 2'. After each removal of a card 13 or the content of cards from a compartment 69 and the depositing of the same in an output apparatus 42, the shuffling storage means 2' is rotated further in a random fashion, so that the next removal can occur from another compartment 69. In this way a shuffling-out process is performed in addition to the shuffling-in process in the shuffling storage means 2' (double shuffling). The relevant aspect is that in total only as many cards are removed from the shuffling storage means 2' and are deposited in the output apparatus 42 so that the preset required number of cards per player is achieved (hand of playing cards). After reaching this number no further cards 13 are taken from the compartments 69. In the case of the withdrawal of merely one card from one compartment 69 of the shuffling storage means 2' it is thus necessary to repeat the process of withdrawal according to the number of required cards per player. In the case of removing all cards from a compartment, it is necessary that the microprocessor always stores how many cards are already stored in a compartment when shuffling in the cards into the shuffling storage means. When emptying the compartment, the microprocessor can then calculate which compartments need to be emptied in order to enable the deposit of the required number of cards in the depositing apparatus 42.

Once the preset number of cards has been deposited in the output apparatus 42, the game leader will notice that the shuffling process is completed and that a stack of cards is present in the output apparatus 42. He can pick up the same with one hand and immediately hand it over to a player. The counting of the cards is no longer required. As soon as the output apparatus is empty, this is recognized by a sensor 101 and the card shuffler begins removing the hand of playing cards from the card shuffling storage means 2' for the next player.

The invention claimed is:

1. A method performed by a card shuffler, the card shuffler having a movable storage device with compartments, the method comprising:

a. receiving unshuffled cards in an input portion of the shuffler;

b. transporting a card from the input portion to the movable storage device;

c. controlling movement of the storage device such that a transported card is received by a randomly selected radial compartment and clamping cards within said selected radial compartments;

d. controlling movement of the storage device to output at least one card from a randomly selected compartment to an output portion; and e. repeating step d one or more times until an entire hand of cards is deposited in the output portion, a hand being the initial number of cards a player needs to play a particular game for which the shuffler is being used, further comprising sensing an absence of cards in the output portion and performing step d to supply cards to the output portion, and wherein a spring is provided with a bend-off which covers radially outer openings of the compartments and prevents cards from being ejected outwardly by centrifugal force during rotation of the carousel.

* * * * *